US006179212B1

(12) United States Patent
Banko

(10) Patent No.: US 6,179,212 B1
(45) Date of Patent: Jan. 30, 2001

(54) VARIABLE OUTPUT MULTISTAGE GAS FURNACE

(76) Inventor: Edward J. Banko, 5801 Malvern Rd., NW., Roanoke, VA (US) 24012

( * ) Notice: Under 35 U.S.C. 154(b), the term of this patent shall be extended for 0 days.

(21) Appl. No.: 09/244,028

(22) Filed: Feb. 4, 1999

(51) Int. Cl.[7] ..... G05D 23/00; F25B 29/00
(52) U.S. Cl. ..... 236/1 E; 165/261; 431/281
(58) Field of Search ..... 126/116 A; 431/280, 431/278, 281; 236/1 E, 1 A, 11; 165/260, 261

(56) References Cited

U.S. PATENT DOCUMENTS

| | | | | |
|---|---|---|---|---|
| 948,133 | | 1/1910 | Coyle | 126/116 |
| 1,918,265 | | 7/1933 | Hartwig | 236/1 E |
| 2,300,560 | * | 11/1942 | Faber | 236/1 E |
| 2,470,996 | | 5/1949 | McGrath | 236/1 E |
| 4,614,491 | * | 9/1986 | Welden | 431/281 X |

OTHER PUBLICATIONS

Maxitrol Company, 23555 Telegraph Rd, POBox 2230, Southfield MI 48037 Bulletins MT 2035 (7 pgs) and 1–3031 (2 pgs).

* cited by examiner

*Primary Examiner*—William Wayner
(74) *Attorney, Agent, or Firm*—Clyde I. Coughenour

(57) ABSTRACT

A high turn down ratio furnace is attained by plural burners or burner stages having control valves operated by thermal sensors. Heat output control is by a variable pressure device for the fuel supplied to the burners and individual on-off valves for some of the burners. Burner arrangement and/or design and control enables one primary burner to ignite a secondary burner so that it can ignite other secondary burners, so that only one flame ignition device at the primary burner is necessary.

18 Claims, 1 Drawing Sheet

VARIABLE OUTPUT MULTISTAGE GAS FURNACE

BACKGROUND OF THE INVENTION

1. Field of the Invention

A variable output gas furnace has multistage gas burners that provide a variable heat output depending on need using variable fuel pressure and plural independently operable valves for the burners.

2. Description of Related Art

The turn down ratio of a furnace is the maximum firing rate divided by the lowest stable, clean firing rate at which a furnace can be operated.

$$\text{Turn Down Ratio} = \frac{\text{maximum firing rate}}{\text{minimum firing rate}}$$

High turn down ratio capability is desirable in furnaces used in applications heating outside air to provide close control of the temperature of air leaving the furnace and entering an enclosure. As the outside air temperature increases and approaches the desired enclosure air temperature, less heat is required.

Presently commercial indirect gas fired duct furnaces are marketed by several manufacturers, and have a maximum turn down ratio of about 2.5 to 1. Therefore, the minimum firing rate is about 40% of the maximum firing rate. Good control of air temperature is achieved when outside air temperatures are low enough to be in the range of from 40% to 100% of the maximum firing rate. If the temperature difference between the desired supply air temperature and the outside air temperature is less than 40% of the furnace capability, the furnace must operate in a short cycle or rapid "on-off" mode which results in poor temperature control. When the furnace is "on", the air is overheated. When the furnace is "off", there is no heating. The "heat sink" characteristics of the furnace heat exchanger tend to reduce leaving air temperature oscillations, but uncomfortable air temperatures still often result.

The use of gas burners for heating air is common with various provisions made for adjusting the heat output for different seasons of the year and times of the day. F. Coyle, U.S. Pat. No. 948,133, issued Feb. 1, 1910, teaches plural burners in a single combustion box with independently operated burners and adjustable burn rates for each burner. W. Hartwig, U.S. Pat. No. 1,918,265, issued Jul. 18, 1933, teaches a plurality of burners operated by a thermostat and electromagnetic actuators with constantly available pilot or other ignition means. W. L. McGrath, U.S. Pat. No. 2,470,996, issued May 24, 1949, teaches plural burners with a common supply and individual burner control to vary the number of burners in operation and a main controller for varying the fuel flow and pressure in the supply conduit.

SUMMARY OF THE INVENTION

The invention provides a variable output gas fired air heater having a simplified structure and control while increasing the turn down ratio. By controlling fuel line pressure and placing individual burners concentrically or serially around a central or primary burner or by placing burners in parallel close to a central or primary burner and one another, and by having adjacent burners designed and/or close enough together to ignite one another's fuel supply and by supplying fuel to the burners sequentially outwardly from the centrally located or primary burner, a single pilot or ignition means is all that is necessary. By supplying variable fuel line capacity and selectively shutting off fuel completely to individual burners, any heat capacity from near zero to maximum can be had economically. All burners have a common variable fuel supply available with an on/off control for most of the burners.

DESCRIPTION OF THE PREFERRED EMBODIMENTS

Figure 1:
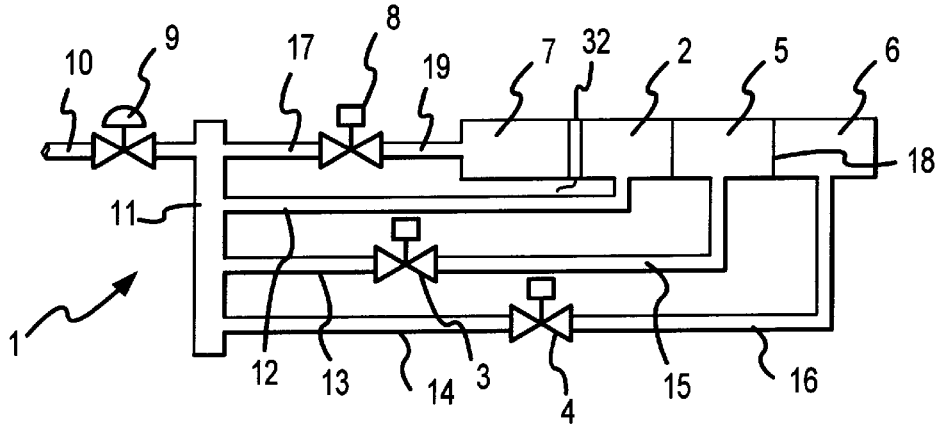
FIG. 1 represents a side view of a furnace with plural burners having a common fuel pressure regulator and all but one primary burner individually controlled.

The present gas firing ratio modulation can be achieved by varying the gas pressure in a gas manifold that feeds all the burners in a furnace. The manifold pressure at the maximum firing rate (100%) is usually a 3.5 inch water column ("w.c.). The manifold pressure at the minimum firing rate (40%) is about a 0.6" w.c. The gas pressure in the manifold is varied by an electronically controlled gas pressure regulator, in response to a modulating signal generated from a temperature sensor in the air stream inlet and/or leaving or exiting the furnace and/or in the enclosure being heated.

The minimum firing rate is essentially the lowest firing rate that can be maintained with clean, stable, continuous combustion at the burner. The burners are preferably atmospheric burners in which primary combustion air is induced into the gas jet by the velocity of the gas from a fixed orifice. At manifold pressures less than 0.6" w.c., the gas jet has insufficient velocity to induce the required amount of primary combustion air for stable, clean, continuous combustion.

The alternative is a furnace having a plurality of burners, that can be fired individually or in groups or stages, to provide a variable output. The first burner turned on can be an internal or an end burner but is preferably placed in a central location. This primary burner is positioned so that a single pilot light or other flame initiation device can start a flame at the primary burner. The burner fuel outlets are shaped and/or positioned so as to be close enough to other burners to ignite the fuel in one or more adjacent burners. By sequentially opening the on/off valves of adjacent burners, the flames from the primary burner and then the secondary burners can be ignited in a serial or sequential manner. In this way any number of burners can be ignited or extinguished in sequence with the primary burner being the first to be ignited, and it can be, but not necessarily should be, the last to be extinguished. With this arrangement, only one pilot light or ignition means is necessary to give a furnace an infinitely variable output over the total heat output range of the furnace. This is accomplished by having the maximum heat output of the primary burner essentially equal to that of each of the other secondary burners in the furnace. The primary burner control enables it to produce heat that can vary anywhere from minimum to maximum as determined by fuel supply pressure and burner capacity or size. By use of a thermostatic control operating in concert with solenoid valves of the secondary burners and the variable fuel control of the fuel supply for the primary and secondary burners, output of from the minimum to the maximum of the furnace can be obtained. While there are many devices that can control the flow of gas to the burners, a preferred valve is one of the valves manufactured by MAXITROL Company® under the name Selectra®. These valves, especially models MR 410, 510 and 610 are designed for use with atmospheric burners in space heaters. They use a diaphragm controlled by the opposing forces of springs and voltage controlled solenoids. Maximum, 100% at 3.5" w.c., to minimum, approximately 40% at 0.6" w.c., allowable pressure for stable combustion results from the valve modulation of the fuel in the burner supply line.

The ignition from the primary burner of the furnace to one or more secondary burners and/or one secondary burner to another can be accomplished by the arrangement of the burner ports, the proximity of one burner to another, the elevation of one burner with respect to another, control of all fluid-flow between the burners, or a combination of two or more of these arrangements.

When full capacity of the primary burner is reached, a secondary burner is activated. Each time a secondary burner is placed on line, by opening the valve to it, the amount of fuel supplied to all the active burners, can be reduced to meet a required intermediate heat demand. This procedure is followed until the furnace reaches full operating capacity. Control is by one or more sensors, located at or near the heater or furnace inlet and/or discharge and/or within the enclosure being heated, supplying information to a digital controller or program that operates the valves. The controls routinely contain time delays and dead bands to prevent short cycling and searching.

FIG. 1 is a diagram of an example of a heater or furnace having a fuel supply 10 with a number of branch outlets off of a distribution conduit or pipe 11. The distribution conduit supplies an uninterrupted flow of fuel to a primary burner 2 through a pipe 12. A thermally modulated variable pressure control valve 9, between a fuel supply pipe 10 and distribution conduit or pipe 11, adjusts the pressure of the fuel to the burners in response to enclosure heating needs. Secondary burner sections 5, 6, 7, are supplied fuel through outlet pipes 13, 14, 17 that supply fuel to the secondary burners through burner inlet pipes 15, 16, 19 with two-position (on-off) valves 3, 4, 8 controlling fuel flow to the secondary burners. The preferred on-off valves are solenoid operated valves. The variable control valve 9 adjusts the pressure in the distribution fuel pipe 11. The fuel pressure available to the primary burner is at all times under the direct control of the variable control valve with this same fuel pressure available to the secondary burners or two-position valves 3, 4, 8 used to control fuel to them. The pipes 12, 15, 16, 19 are independent of one another and the burners 2, 5, 6, 7 are separated from each other by permanent dividers 18 that preclude internal fuel passage between burners but permit fuel ignition externally from one burner to another if the burners are of an integral construction. The burners can be individual burners joined together to form the heating device in which event separators will not be necessary.

Figure 2:
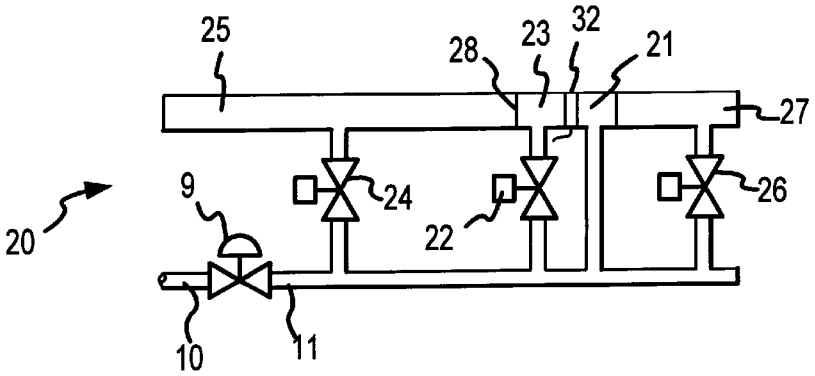
FIG. 2 represents a side view of a furnace similar to that represented in FIG. 1, but having stages that can have more than one burner in each stage.

Rather than having all individual burners each under control of a separate on-off valve, burners may be arranged in groups or clusters or stages. Different numbers of burners can be grouped into these stages with an individual stage under the control of a single on-off valve. Any number of stages can be arranged into a single heater or furnace depending on the physical facilities and arrangement of the enclosures to be heated. FIG. 2 illustrates one of the many linear groupings of burners that can be made. A single burner is shown as a first stage 21, one burner is shown as a second stage 23, four burners are shown as a third stage 27, and eight burners are shown as a fourth stage 25. The stages are separated by dividers 28 that preclude fuel passage internally between stages while fuel is free to flow to all the burners within a given stage. As in FIG. 1, fuel supply pipe 10 has a variable pressure control valve 9 that controls pressure in the distribution pipe 11. The first stage 21 is always under the pressure in the distribution pipe as the flow path is uninterrupted between the variable valve 9 and the burner 21. The two way valves 22, 24, 26, that control fuel flow to the secondary burner stages 23, 25, 27, are also under the pressure within the distribution pipe.

As one example of many possible arrangements, a first stage with one burner, and a second stage with one burner, and a third stage with four burners, and a fourth stage with eight burners can be used as shown in the elongated representation of FIG. 2. The horizontal length is drawn in ratio to the number of burners being represented in each stage. It is arbitrarily assumed for purposes of illustration that an individual burner at full fuel pressure (e.g. 3.5" w.c.) can produce 10 BTU's heat, and at minimum effective fuel pressure (e.g. 0.6" w.c.), 40% of maximum heat or 4 BTU's can be produced over a specific period of time. With all burners being of the same capacity and under control of the pressure determined by the variable pressure control valve, the output of each individual burner is limited to this same heat output range. The output or heat capacity range for each burner is variable from 4 BTU's to 10 BTU's. The resulting available heat output range for the first stage with one burner is from 4 to 10 BTU's. The available heat output is from 4 to 10 BTU's for the second stage having one burner. The available heat output from the third stage with four burners is from 16 to 40 BTU's. The available heat output from the fourth stage with eight burners is from 32 to 80 BTU's. Igniting the primary burner and first stage gives a heat range of from 4–10 BTU's. Adding the second stage to the first stage gives a heat range of from 8 to 20 BTU's. Adding the third stage to the first stage gives a heat range of from 20 to 50 BTU's. Adding the second and third stages to the first stage gives a heat range of from 24 to 60 BTU's. Selectively adding in the fourth stage to these multi-stage combinations yields a minimum of from 36 to 56 BTU's and a maximum of from 90 to 140 BTU's. The overlapping heat output of these combinations makes available an uninterrupted heat range of from 4 BTU's to 140 BTU's. The turn down ratio for this configuration would be 140/4 or 36.5.

This can be compared to an arrangement where each stage contains only one burner, such as shown in FIG. 1. Each stage would make available from 4 to 10 BTU's heat to the enclosure being heated. The minimum heat available to the furnace is 4 BTU's and the maximum heat available is 40 BTU's. The turndown ratio is 40/4 or 10.

Figure 3:
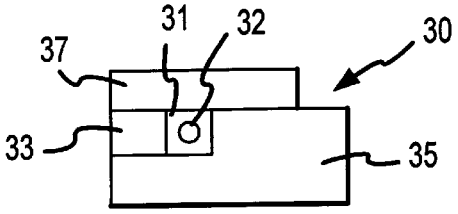
FIG. 3 represents an example of a top view of burner stages having different numbers of burners.
Figure 4:
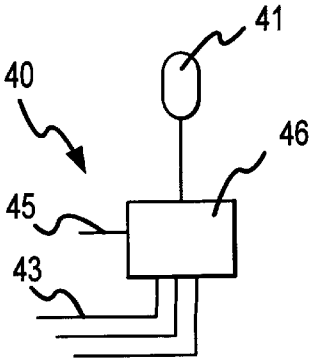
FIG. 4 illustrates a schematic of the fuel flow control.

FIG. 3 depicts one of any number of cluster burner arrangements that can be made. The overall burner configuration 30 consists of a primary single burner first stage 31, a secondary single burner second stage 33, a four burner secondary third stage 37, and an eight burner secondary fourth stage 35. The second, third and fourth stages can each selectively be ignited from the first stage. While the burners are shown as being essentially square and forming essentially rectangular stages, the burners can be round or any other shape and the stages arranged in an oval or in any desirable configuration as long as the basic concepts of the invention are provided for. An ignition device 32 is shown associated with the primary burner first stage 31.

The examples of FIGS. 1 and 2 do not have any gaps between the stages where heating cannot be provided between the maximum and minimum heating capacity of the furnace. If individual burner output is again arbitrarily taken to be from 4 to 10 BTU's over a specific period of time, relatively small gaps may be encountered with some burner stage arrangements. Even these can be tolerated with the scheme of the invention. As an example, a three-stage furnace having a total of eight burners will have a small gap. A first stage can have one burner, a second stage can have two burners and a third stage can have five burners. With this combination there will be a small gap between the maximum and minimum heating capacity of the furnace. The first stage with one burner can provide from 4 to 10 BTU's, the second stage with two burners can provide from 8 to 20 BTU's, and the third stage with five burners can provide from 20 and 50 BTU's. As the heating demand is increased from 4 BTU's to 30 BTU's, the second stage must be activated as the first stage is only able to provide up to 10 BTU's and the second stage can only provide from 8 to 20 BTU's. Combined they can provide from 12 to 30 BTU's. This means there will be a gap of 2 BTU's that the combined stages cannot provide for, between the demand for 10 and 12 BTU's. While the demand for 11 BTU's, for example, may lead to a minor short cycling or on-off switching back and forth between having only the first stage burner on and having both the first and second stage burners on, it would be minimal and would even then be corrected to some degree by the standard heat sink characteristics of furnaces or by a built in heat storage means.

The larger the number of stages, the higher the cost. The arrangement of the stages and staging controls for the burners as disclosed enables the highest turn down ratio to be manufactured and maintained at the lowest cost. The invention enables a relatively even heat supply to be selected at a minimal expense using a minimal number of furnace components.

It is believed that the construction, operation and advantages of this invention will be apparent to those skilled in the art. It is to be understood that the present disclosure is illustrative only and that changes, variations, substitutions, modifications and equivalents will be readily apparent to one skilled in the art and that such may be made without departing from the spirit of the invention as defined by the following claims.

What is claimed is:

1. A fluid fuel burning furnace system having a plurality of fuel burners including:

a primary burner stage and a plurality of secondary burner stages;

said primary burner stage having a heat capacity range determined by its size and its fuel supply;

said secondary burner stages having heat capacity ranges that are a multiple of said primary burner heat capacity range;

a variable fuel supply control for supplying fuel to said primary burner stage and to said secondary burner stages to vary the amount of fuel available to all said burner stages;

said primary burner stage at all times being directly supplied with fuel under the control of said variable fuel supply control;

an individual control valve for each said secondary burner stage between said variable fuel supply control and each said individual secondary burner stage;

thermal means for operating said variable fuel supply control for supplying fuel to said primary burner stage and to said secondary burner stages and for operating said individual control valve for each said secondary burner stage so as to give an infinitely variable heat range and a high turn down ratio for said furnace.

2. A fluid fuel burning furnace system having a plurality of fuel burners as in claim 1 wherein:

one said secondary burner stage has a heat capacity range that is at least twice said primary burner stage heat capacity range.

3. A fluid fuel burning furnace system having a plurality of fuel burners as in claim 1 wherein:

each said burner stage is designed and positioned closely adjacent to another said burner stage so that a flame of one said burner stage will ignite fuel supplied to said adjacent burner stage;

a fuel ignition means is provided for igniting fuel supplied to said primary burner stage, and fuel supplied to said secondary burner is ignited from said primary burner ignited fuel.

4. A fluid fuel burning furnace system having a plurality of fuel burners as in claim 1 wherein:

a single ignition means at said primary burner stage provides the heat necessary for starting a flame at said primary burner stage and said primary burner stage in turn provides the heat necessary for igniting fuel at said secondary burner stages;

a second said secondary burner stage has a heat capacity range that is at least twice said primary burner stage heat capacity range.

5. A fluid fuel burning furnace system having a plurality of fuel burners as in claim 4 wherein:

a third said secondary burner stage has a heat capacity range that is at least three times said primary burner stage heat capacity range.

6. A process for heating an enclosure using a furnace including the steps of:

providing a primary burner stage and a plurality of secondary burner stages;

providing a fuel supply for all said burner stages;

controlling said fuel supply to all said burner stages using a thermally controlled variable valve means;

providing an uninterrupted flow path for fuel from said thermally controlled variable valve means to said primary burner stage;

positioning said primary burner stage adjacent to said secondary burner stage so that burning fuel from said primary burner ignites fuel supplied to said adjacent secondary burner stage;

sequentially supplying fuel to said primary burner first and then to a said secondary burner stage adjacent to said primary burner stage and then to other said secondary burner stages and igniting said fuel supplied to said primary burner and then igniting said fuel supplied to said other secondary burner stages from said ignited fuel supplied to said primary burner stage.

7. A process for heating an enclosure using a furnace as in claim 6 including:

providing said secondary burner stages with a heating capacity range that is a multiple of the heating capacity range of said primary burner stage;

providing each of said secondary burner stages with an on-off valve;

regulating said fuel supply pressure using said thermally controlled variable valve means to control said fuel supply to said primary burner stage and to said secondary burner stages' on-off valves to controllably vary said furnace heat output and give an infinitely variable heat range and a high turn down ratio for said furnace.

8. A process for heating an enclosure using a furnace as in claim 6 including:

providing one said secondary burner stage with a heat capacity range that is at least twice said primary burner stage heat capacity range.

9. A process for heating an enclosure using a furnace as in claim 8 including providing a second said secondary stage with a heat capacity range that is at least three times said primary burner stage heat capacity range.

10. A process for heating an enclosure using a furnace as in claim 6 including the steps of:

positioning individually controlled valves in the fuel supply to each said secondary burner stage;

reducing said fuel supply to all said burner stages each time a said secondary burner stage is supplied with fuel by opening a said individually controlled valve.

11. A process for heating an enclosure using a furnace as in claim 6 including the steps of:

selecting said secondary burner stages to have heat capacity ranges that are multiples of the heat capacity range of said primary burner range;

providing one said secondary burner with a heat capacity range that is at least twice said primary burner stage heat capacity range.

12. A process for heating an enclosure using a furnace as in claim 11 including the steps of:

selecting said secondary burner stages heat capacity ranges and arranging said secondary burner stages to yield a turn down ratio greater than four.

13. A process for heating an enclosure using a furnace as in claim 11 including the steps of:

providing a second said secondary burner stage with a heat capacity range that is at least four times said primary burner heat capacity range.

14. A process for heating an enclosure using a furnace as in claim 6 including the steps of:

selecting said secondary burner stages heat capacity ranges and arranging said secondary burner stages to yield a turn down ratio greater than nine.

15. A fluid fuel burning furnace system having a plurality of fuel burners including:

a primary burner stage and a plurality of secondary burner stages;

said primary burner stage having a heat capacity range determined by its size and its fuel supply;

said secondary burner stages having heat capacity ranges that are a multiple of said primary burner heat capacity range, one said secondary burner stage has a heat capacity range that is at least twice said primary burner stage heat capacity range;

a variable fuel supply control for supplying fuel to said primary burner stage and to said secondary burner stages to vary the amount of fuel available to all said burner stages;

an individual control valve for each said secondary burner stage between said variable fuel supply control and each said individual secondary burner stage.

16. A fluid fuel burning furnace system having a plurality of fuel burners as in claim 15 including:

a second said secondary burner stage having a heat capacity range that is at least four times said primary burner stage heat capacity range.

17. A fluid fuel burning furnace system having a plurality of fuel burners as in claim 15 including:

means for reducing the fuel supply to all said primary burner stages and said secondary burner stages each time a said secondary burner stage is supplied with fuel by opening a said individually controlled valve.

18. A fluid fuel burning furnace system having a plurality of fuel burners as in claim 17 wherein:

said individual control valve for each said secondary burner stage is a solenoid valve.

* * * * *